US010717498B2

(12) United States Patent
Ulgen

(10) Patent No.: US 10,717,498 B2
(45) Date of Patent: Jul. 21, 2020

(54) COLLAPSIBLE UNDERWATER FOIL FOR BOATS CONVERTIBLE TO A HYDROFOIL FROM A TRIM STABILIZER

(71) Applicant: Mehmet Nevres Ulgen, Istanbul (TR)

(72) Inventor: Mehmet Nevres Ulgen, Istanbul (TR)

( * ) Notice: Subject to any disclaimer, the term of this patent is extended or adjusted under 35 U.S.C. 154(b) by 9 days.

(21) Appl. No.: 15/838,578

(22) Filed: Dec. 12, 2017

(65) Prior Publication Data

US 2019/0106179 A1 Apr. 11, 2019

(51) Int. Cl.

| | |
|---|---|
| ***B63B 1/28*** | (2006.01) |
| ***B63B 1/24*** | (2020.01) |
| ***B63B 39/06*** | (2006.01) |
| ***B63B 1/26*** | (2006.01) |
| ***B63B 1/30*** | (2006.01) |
| *B63B 43/04* | (2006.01) |

(52) U.S. Cl.

CPC ..... *B63B 1/285* (2013.01); *B63B 1/242* (2013.01); *B63B 1/26* (2013.01); *B63B 1/30* (2013.01); *B63B 39/061* (2013.01); *B63B 43/04* (2013.01)

(58) Field of Classification Search

CPC .. B63B 1/242; B63B 1/26; B63B 1/28; B63B 1/285; B63B 1/286; B63B 1/30; B63B 39/06; B63B 39/061

See application file for complete search history.

(56) References Cited

U.S. PATENT DOCUMENTS

| | | | | |
|---|---|---|---|---|
| 2,985,130 | A | 5/1961 | Jacobs et al. | |
| 3,062,167 | A | 11/1962 | Bennett | |
| 3,769,927 | A | 11/1973 | Carney | |
| 4,967,682 | A * | 11/1990 | O'Donnell | B63B 39/061 114/286 |
| 5,493,990 | A | 2/1996 | Dyer | |
| 7,707,956 | B2 * | 5/2010 | Moore | B63B 39/061 114/284 |
| 9,340,257 | B2 | 5/2016 | Ulgen | |
| 2009/0101057 | A1 * | 4/2009 | Mueller | B63H 21/213 114/286 |

* cited by examiner

*Primary Examiner* — Ajay Vasudeva
(74) *Attorney, Agent, or Firm* — Vidas, Arrett & Steinkraus, P.A.

(57) ABSTRACT

The invention relates to a trim stabilizer device comprising a foil being structurally independent from the transom of a boat to which it is to be mounted and being tiltable around its transversal axis; a first actuator associated with the foil for tilting thereof; a adjusting arm associated with the foil, at one end, for making a vertical motion thereof relative to the transom, and at the other end, associated with a connecting member provided on the transom. The trim stabilizer device for boats comprises a second actuator for making a vertical motion by a non-manual force of the adjusting arm.

3 Claims, 7 Drawing Sheets

COLLAPSIBLE UNDERWATER FOIL FOR BOATS CONVERTIBLE TO A HYDROFOIL FROM A TRIM STABILIZER

TECHNICAL FIELD

The present invention relates to an improved version of U.S. Pat. No. 9,340,257 including a trim stabilizer device having a retractable underwater foil suitable for use especially in speed boats, in a compact, functional and economical manner.

BACKGROUND OF THE INVENTION

In speed (motor) boats, the boat position and in particular the trim (pitching) of the boat is crucial in terms of cruising performance and fuel economy. Several factors such as load position, speed, the waves and wind in the sea have an effect on trim in motor boats. When the trim of the motor boat increases in relatively fast cruises, stresses occur on both the hull and the motor as the rear of the boat hull is dragged with high resistance in the sea.

Trim tabs have long been used in speed boats to stabilize the trim. Trim tabs are mounted to the transom of speed boats and they comprise a plate, the bottom surface of which structurally contacts with water, and a mounting part that can be fixed to the transom with which the plate is rotatably associated by member of a hinge joint. The stabilization of the trim is provided by an actuator (generally a piston) that can make pressure on the tab from the upper side and therefore rotate the tab. It is important how long the trim tabs extend from the bottom end of the boat transom to downwards (towards sea). Thus, as the trim tab is further from the boat to downwards, the counter pressure that the tab stabilizing the boat trim creates is higher, which provides a trim stabilization by pressing the bow of the boat towards the water. However, when trim decreases, as the boat hull will be more in contact with water, the drag and therefore the fuel consumption increase accordingly.

There are many proposals in the art with regard to trim tabs. For instance, U.S. Pat. No. 3,062,167 discloses a device which is consisted of a foil and a concave-shaped rod which is associated with the foil from one side and with different parts of the trim tabs from the two end sides.

U.S. Pat. No. 2,985,130 discloses a trim tab device that is rotated with the help of a mechanical foil arrangement.

U.S. Pat. No. 3,769,927 discloses a pair of trim tabs which can be adjusted independent of each other. The bottom end of an adjustment foil which is threaded is associated with a bracket on the tab, and as the adjustment foil is rotated, the plate rotates accordingly.

U.S. Pat. No. 5,493,990 discloses a trim stabilizer device associated with a transom of a motor boat, said device comprises a foil being tillable around its transversal axis and the foil being structurally independent from the transom; and an actuator associated with the foil for tilting thereof.

Since the trim tabs of the art are directly associated with the transom of the boat, water flow along the upper surface of the tab may not be possible. When no trim stabilization is needed, the trim tabs are lifted to transom level or to a higher level (i.e. above the water level); however, this does not contribute to the fuel economy of the boat. In this case, it is necessary to use different trim tabs depending on the physical features of the motor boat and its shallow water cruising ability, which is not practical.

The disclosed invention and the invention disclosed in U.S. Pat. No. 9,340,257 addresses the above-mentioned problems. However, the arrangement that ensures displacement of the water foil, having a trim stabilizer function as well, from the transom in vertical direction is manually operated, and the vertical arm to which the foils are connected is maintained in the desired position in the groove of a bushing mounted to the transom by the aid of a connecting member such as a bolt. If the height of the foil is subsequently changed, then the arms to which the foils are connected are to be removed and mounted to another position. On the other hand, in the trim device described in U.S. Pat. No. 9,340,257, there is also proposed a complicated and somewhat expensive proposal for tilting the foils relative to the transom of the boat, in order to space apart the foils from the hull in radial direction.

DESCRIPTION OF THE INVENTION

An object of the present invention is to provide an effective trim control and fuel economy for speed boats (motor boats).

Another object of the present invention is to provide a trim control that can make hulls of motor boats having different physical features compatible with trim control. By adjusting the trim foil parallel to the angle of transom or to the water surface, different stabilizations and buoyancy forces are provided and that the foils can be safeguarded especially on shallow water.

The invention relates to a trim stabilizer device comprising a foil being structurally independent from the transom of a boat to which it is to be mounted and being tiltable around its transversal axis; a first actuator associated with the foil for tilting thereof an adjusting arm associated with the foil, at one end, for making a vertical motion thereof relative to the transom, and at the other end, associated with a connecting member provided on the transom; characterized in that the adjusting arm comprises a second actuator for making a vertical motion by a non-manual force.

According to an embodiment of the invention, the second actuator is a hydraulic or electrical operated piston.

According to an embodiment of the invention, there is provided a casing part for protecting the first and second actuators from water which is movable in vertical direction.

BRIEF DESCRIPTION OF THE DRAWINGS

For a better understanding of the configuration and advantages of the present invention, along with its additional elements, it should be evaluated in reference to the accompanying drawings, wherein.

REFERENCE NUMBERS OF THE PARTS IN THE DRAWINGS

Figure 1:
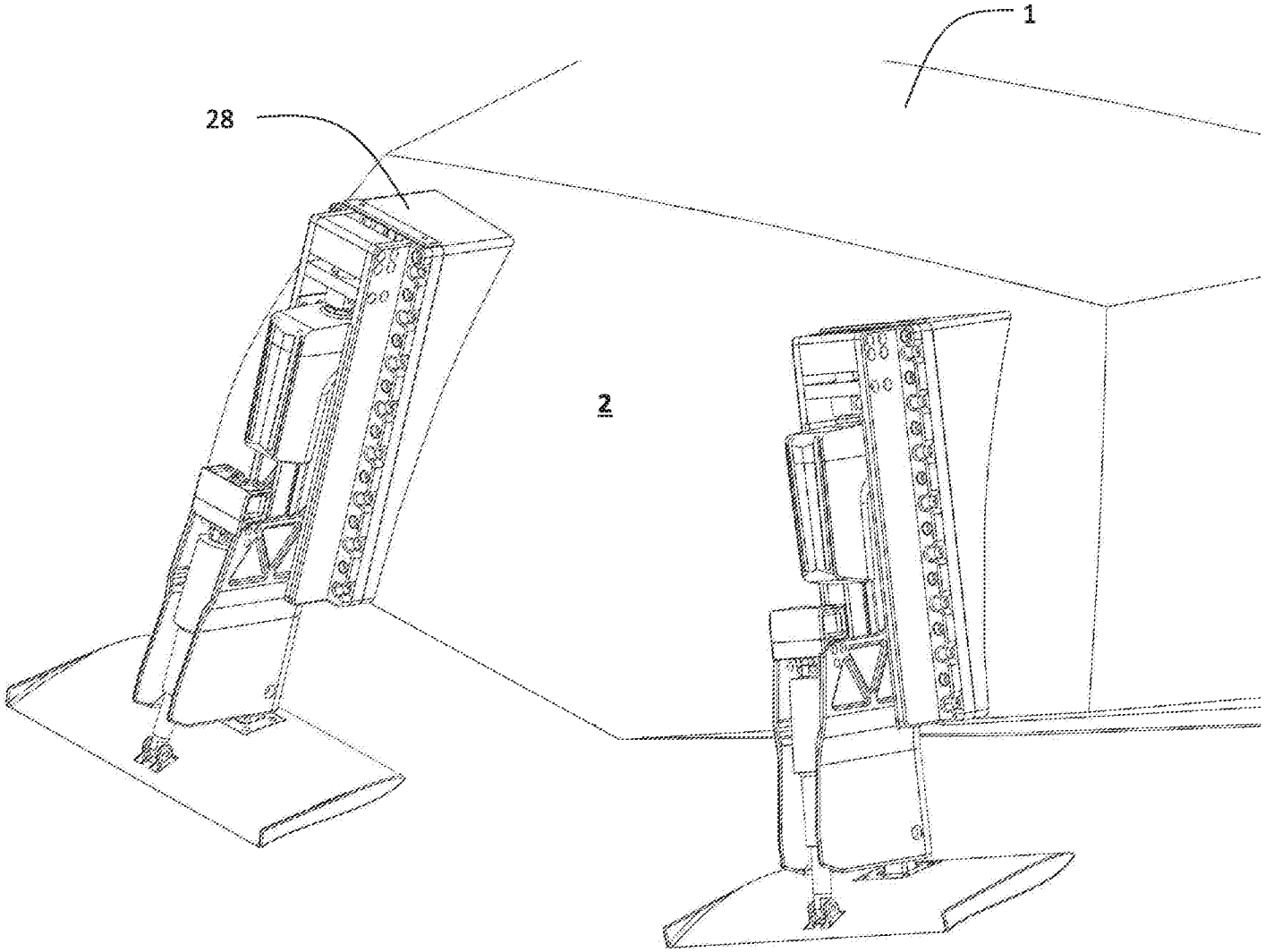
FIG. 1, a pair of trim stabilizer devices according to the invention mounted to the transom of a boat is shown.
Figure 2:
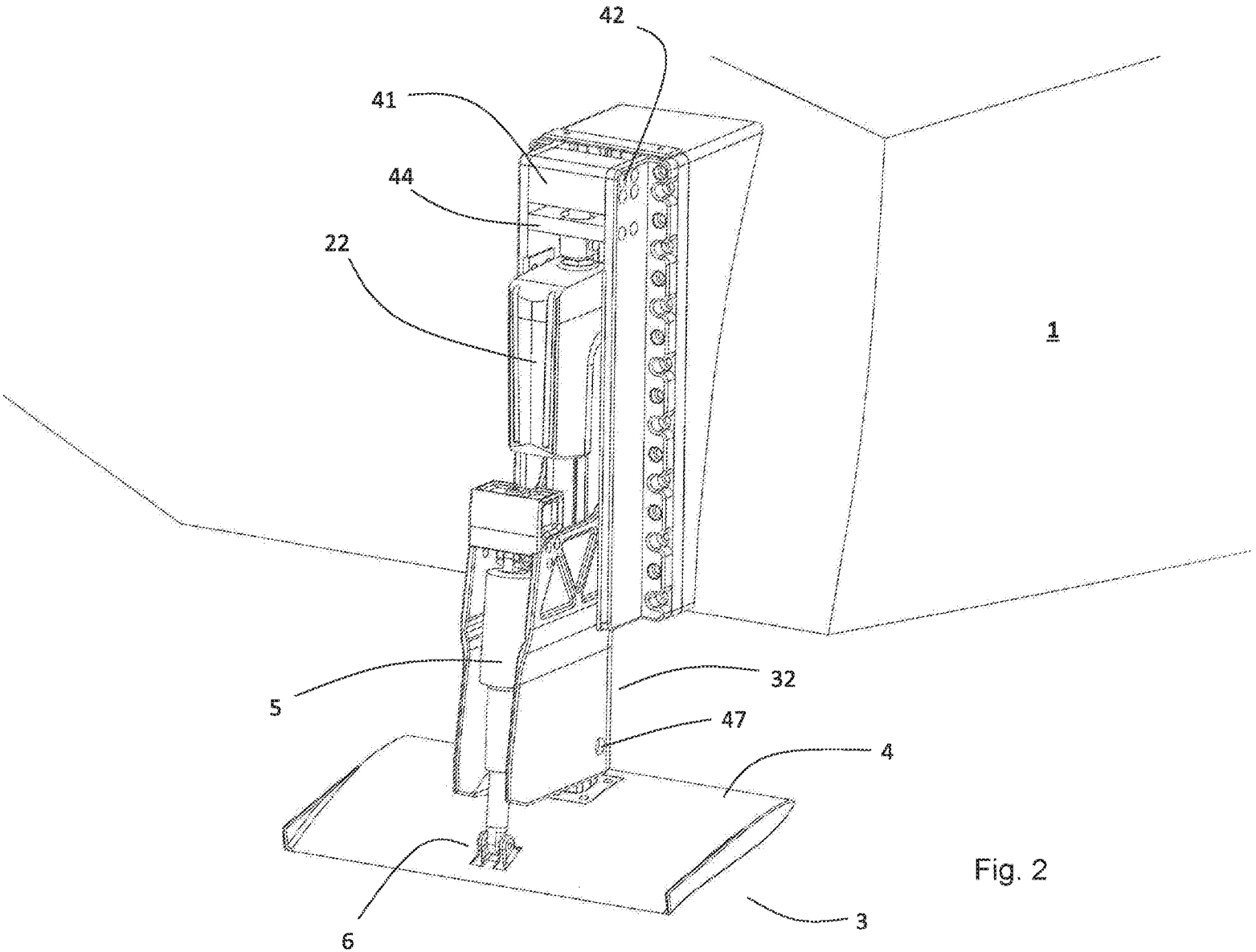
FIG. 2, a trim stabilizer device according to the invention mounted to the transom of a boat is shown.
Figure 3:
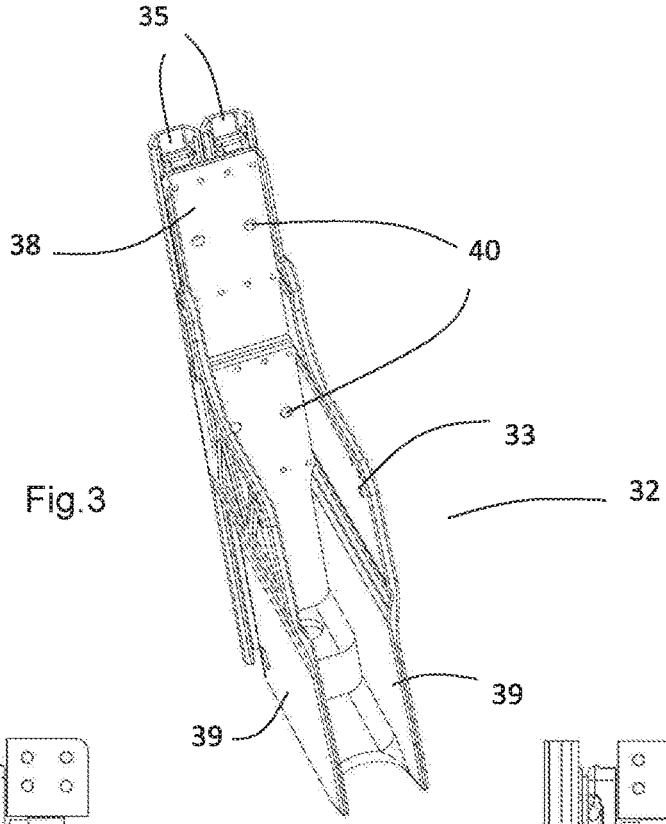
FIG. 3, a perspective view of a casing part is shown.

1 Boat
2 Transom
3 Foil
4 Foil upper surface
5 First actuator
6 Connection of the first actuator and foil
7 Connection of the second actuator and foil
8 Lower end of the second actuator
9 Second actuator lower pin bearing end
10 Upper pin
11 Lower pin
12 Upper pin hole
13 Lower pin hole
14 Pin upper bearing
15 Pin lower bearing
16 Pin upper bearing bolt hole
17 Pin lower bearing bolt hole
18 Pin upper bearing slot
19 Pin lower bearing slot
20 Pin flange of pin upper bearing
21 Pin flange of pin lower bearing
22 Second actuator
23 First actuator upper end connecting member
24 First actuator upper pin bearing end
25 Fastening screw of the first actuator upper pin bearing end
26 First actuator upper pin bearing end holes
27 Second actuator upper end
28 Transom connecting member
29 Vertical support
30 Vertical support bolt holes
32 Casing
33 Casing part connecting holes
34 Upper end connecting holes
35 Rail
36 Slide
37 Roller
38 Casing front wall
39 Casing side wall
40 Holes of the casing front wall
41 Second actuator upper end connecting member
42 Connecting holes of the vertical support and upper end
44 Spacer
45 Spacer connecting holes
46 Slide connecting holes
47 Casing pin connecting hole
49 Screw inlet opening
50 Bolt hole

DETAILED DESCRIPTION OF THE INVENTION

Figure 4:
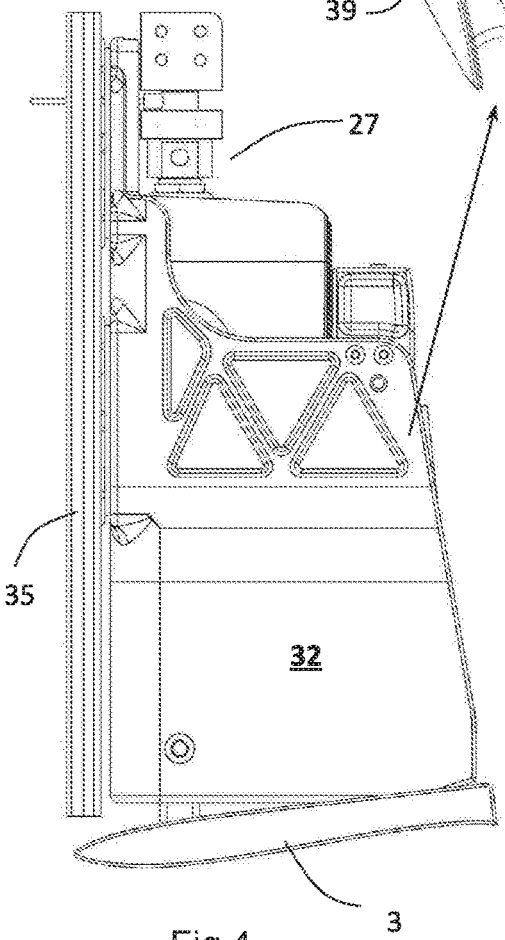
FIG. 4, a side view of the trim stabilizer device according to the invention is shown, with the foil inclined downwards.
Figure 5:
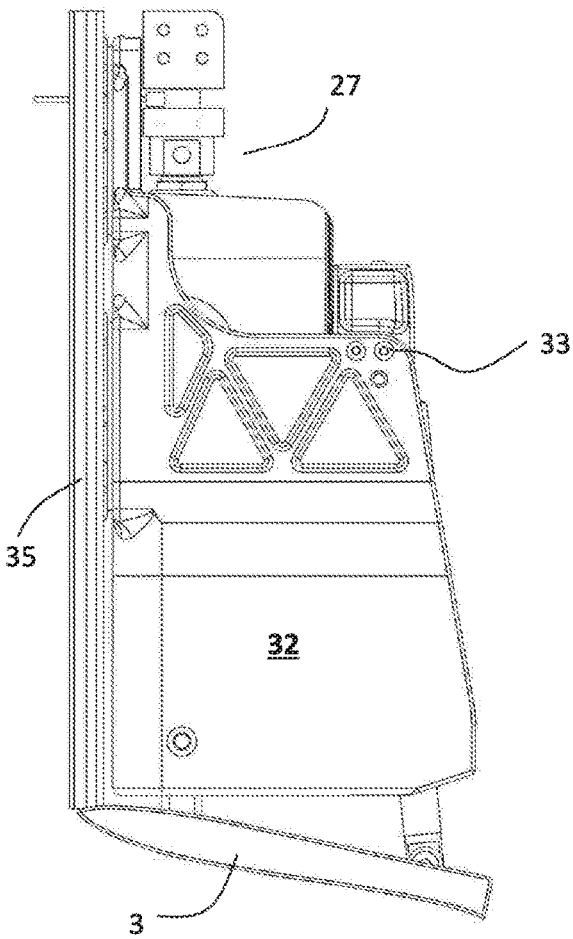
FIG. 5, a side view of the trim stabilizer device according to the invention is shown, with the foil inclined upwards.
Figure 7:
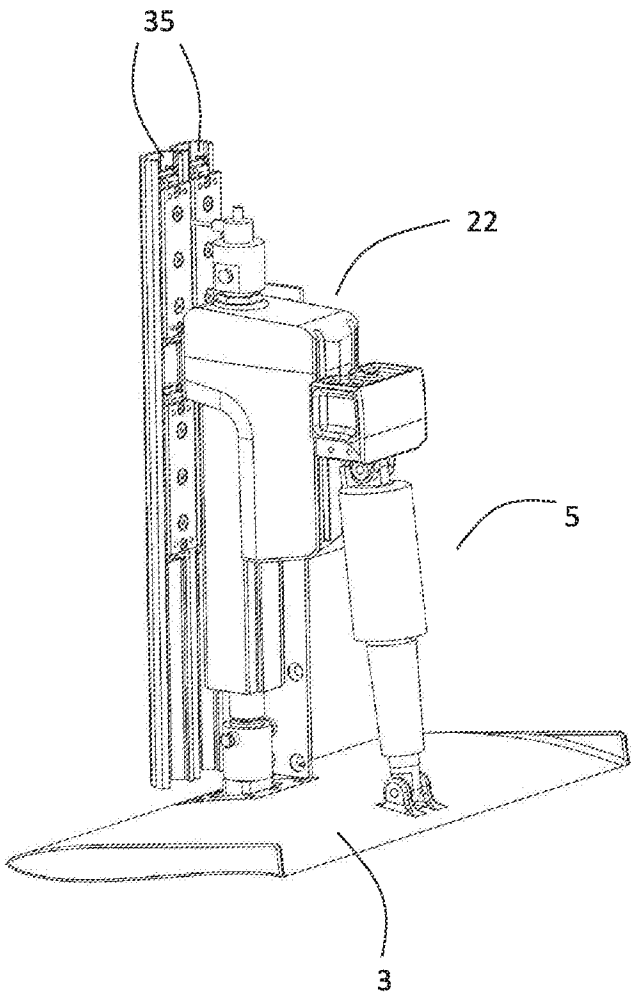
FIG. 7, a simplified perspective view of the trim stabilizer device according to the invention is shown, with the foil being closed.
Figure 6:
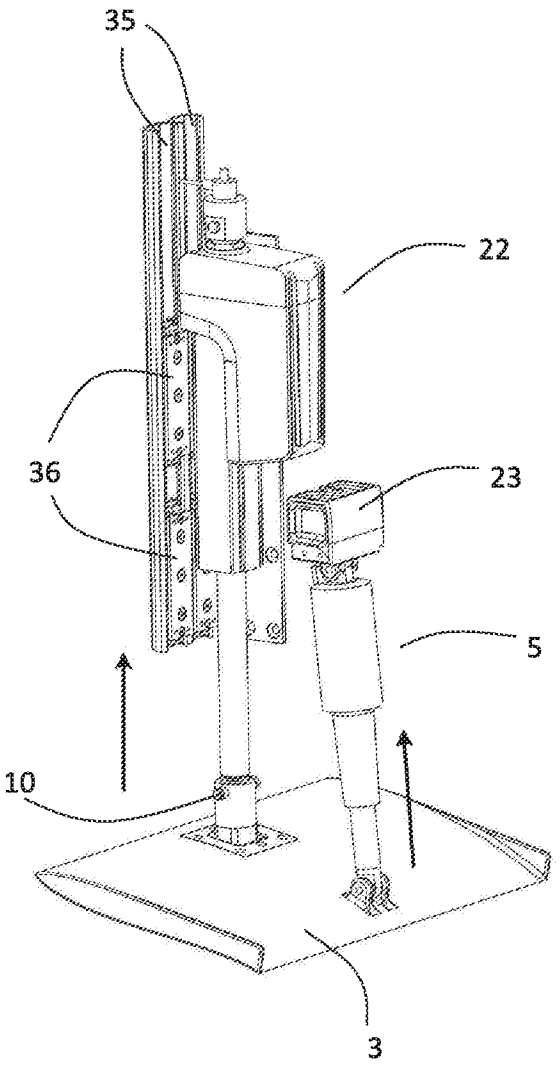
FIG. 6, a simplified perspective view of the trim stabilizer device according to the invention is shown, with the foil being opened.

A foil trim stabilizer device according to the invention is mounted on the surface of the transom (2) of a motor boat or speed boat (1) by member of a connecting member such as a bolt. For fastening purposes, a transom connecting member (28) is arranged which is mainly extending in a vertical manner from the transom (2) having preferably a longitudinal form. The foil trim stabilizer device comprises a foil (3) moveable upwards and downwards in vertical direction, as described in U.S. Pat. No. 9,340,257. The foil (3) is capable of tilting about its transversal axis, as shown in FIGS. 4 and 5. For this, a first actuator (5) is provided which is at one end connected to the upper surface (4) of the foil (3) (preferably at the rear part and on the transversal center point) by means of a rotary pin (6) and which is preferably a piston, as described in U.S. Pat. No. 9,340,257. At the other end, the first actuator (5) is then associated with a casing (32) to be described later on.

Figures 16, 17, 18, 19, 20:
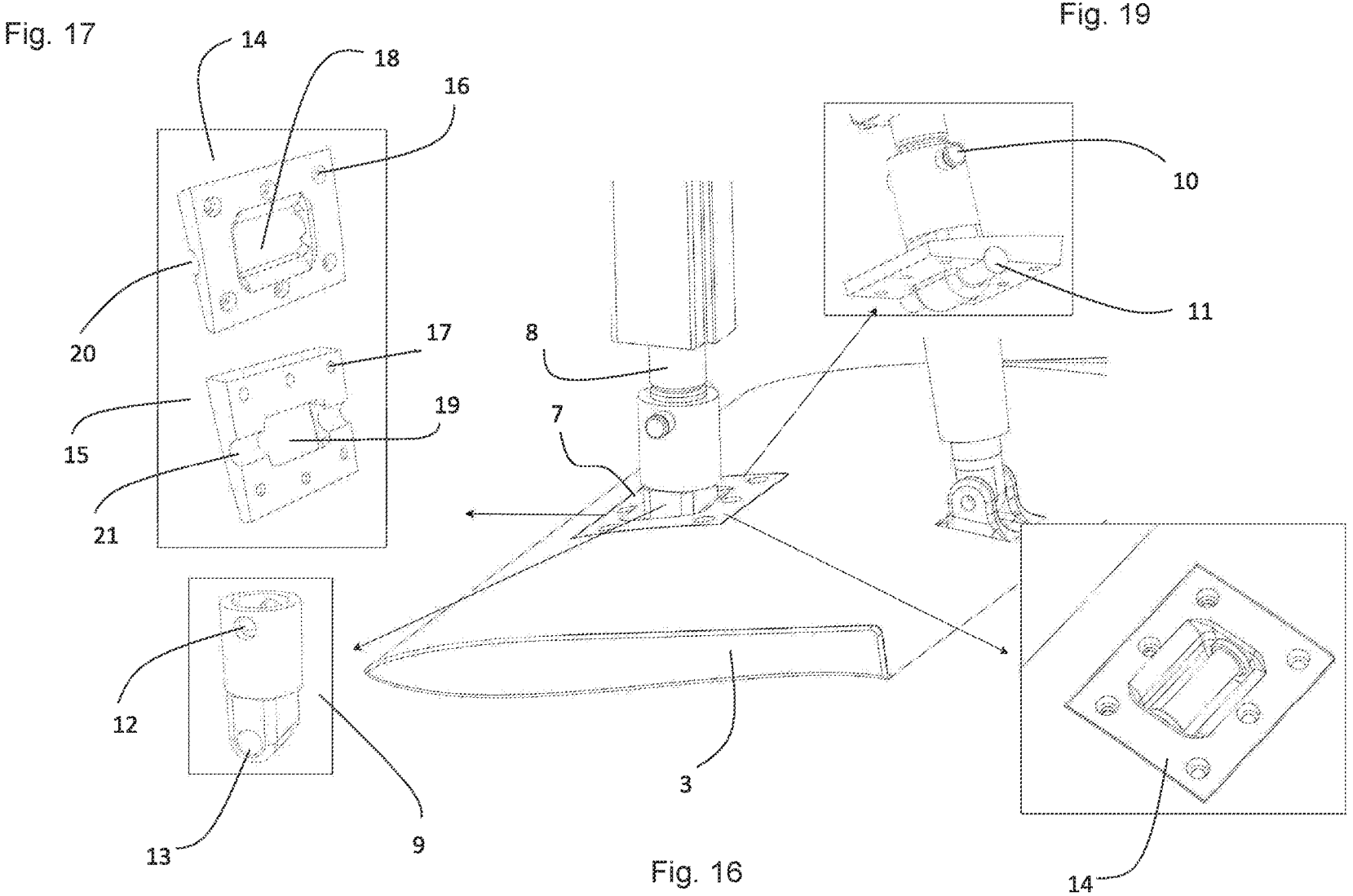
FIG. 16, the connection of the second actuator and the foil is shown.
FIG. 17, a view of the pin bearings is shown.
FIG. 18, a view of the second actuator lower pin bearing end is shown.
FIG. 19, a view of the montage of the lower pin to the upper bearing is shown.
FIG. 20, a perspective view of the lower pin inside the upper bearing is shown.

A second actuator (22) is provided which is, at one end and on the transversal center point, connected to the front part of the upper surface (4) of the foil (3). The connection (7) of the second actuator (22) with the foil (3) is performed by means of a lower pin (11) in rotatable manner, as shown in FIG. 19. The lower pin (11) is mounted in a pin bearing arranged in a slot made on the foil (3). This pin bearing comprises an upper pin bearing (14) arranged on the upper side of the foil (3) and a lower pin bearing (15) arranged on the lower side of the foil (3). They comprise a pin upper bearing slot (18) and a pin lower bearing slot (19), respectively, located at their mid-section. The pin upper bearing (14) comprises various circumferential pin upper bearing bolt holes (16) and similarly, the pin lower bearing (15) comprises various circumferential pin lower bearing bolt holes (17). These holes are aligned and said parts are secured to each other by means of bolts.

At the lateral sides of the pin upper bearing slot (18) and at those sections facing inside of the foil, pin flanges of pin upper bearing (20) are formed extending opposite to each other, and similarly, at the lateral sides of the pin lower bearing slot (19) and at those sections facing inside of the foil, pin flanges of pin lower bearing (21) are formed extending opposite to each other. After the lower pin (11) is passed through a lower pin hole (13) formed on the second actuator lower pin bearing end (9), it rests on the said surfaces (20, 21). The upper end of the actuator lower pin bearing end (9) has a hollow cylindrical form, which cylindrical form comprises opposite upper pin holes (12). The lower end of the second actuator (8) is inserted in the hollow cylindrical part of the actuator lower pin bearing end (9), and the lower end of the second actuator (8) is connected with the actuator lower pin bearing end (9) by means of an upper pin (10).

The second actuator (22) is preferably a hydraulic piston or an electrical operated piston. In the drawings, the lower end of the piston rod is shown as associated with the foil. The second actuator (22) is associated with a vertical support (29) at its upper end. The vertical support (29) has an elongate "L" shape, and it is secured to the transom connecting member (28) by means of the bolts passed through the vertical support bolt holes (30) made on its short edge. The vertical supports (29), namely two, extend reciprocally in vertical direction and spaced apart from each other. At the upper part of the slot located between the vertical supports (29), a second actuator upper end connecting member (41) is fastened. For this, vertical support-upper end connecting holes (42) are made on opposite surfaces of each vertical support (29), and corresponding to these, upper end connecting holes are formed on opposite lateral surfaces of the second actuator upper end connecting member (41). Said holes are aligned and the parts are connected by means of the bolts. In order to increase connection safety, an independent spacer (44) may be placed on the lower part of the second actuator upper end connecting member (41). The spacer (44) in turn comprises connecting holes on the opposite lateral surfaces facing to the vertical supports (29), which are aligned with the opposite holes made on the vertical supports (29) and associated by means of the bolts. The hole made on the center of the spacer (44) allows passage of the upper end (27) of the second actuator (22) therethrough.

A casing (32) in the form of a "U" form (e.g. arcuate between the closed end and lateral sections) is provided in order to reduce the impact of water on the first and second actuators (5, 22) when the foil (3) is opened, e.g. it is moved downwards. The closed end of the "U" form is positioned to receive water while the boat is navigating forward, and the first actuator (5) remains in the inner space of the casing (32). The casing (32) is associated with the movable rod of the second actuator (22). Thus, it is capable of moving upwards and downwards with the movement of the second actuator (22).

"U" shaped rails (35) are provided which extend downwards in vertical direction facing the second actuator (22) at the center of the transom connecting member (28). Slides (36) are arranged which are capable of moving upwards and downwards in the groove of these rails (35). Each slide (36) consists of a plate and various rollers (37) (three are shown in the drawings) extending vertically at a side thereof. The rollers (37) are received in the grooves inside the rails (35) and the rear face of each slide (36) corresponds to the front wall (38) of the "U" shaped casing. Holes (40) are formed on the casing front wall, which are aligned with the slide connecting holes (46) formed on the slides (36) and then bolted. Thus, the casing (32) is slid into the transom connecting member (28).

The upper pin (10) located at the top of the second actuator lower pin bearing end (9) is engaged into the casing pin connecting holes (47) made opposite to each other on the front, lower end sections of the casing side wall (39). Thus, when the second actuator (22) rod is moved, the casing (32) is also moved along with it.

Figures 8, 9, 10, 11:
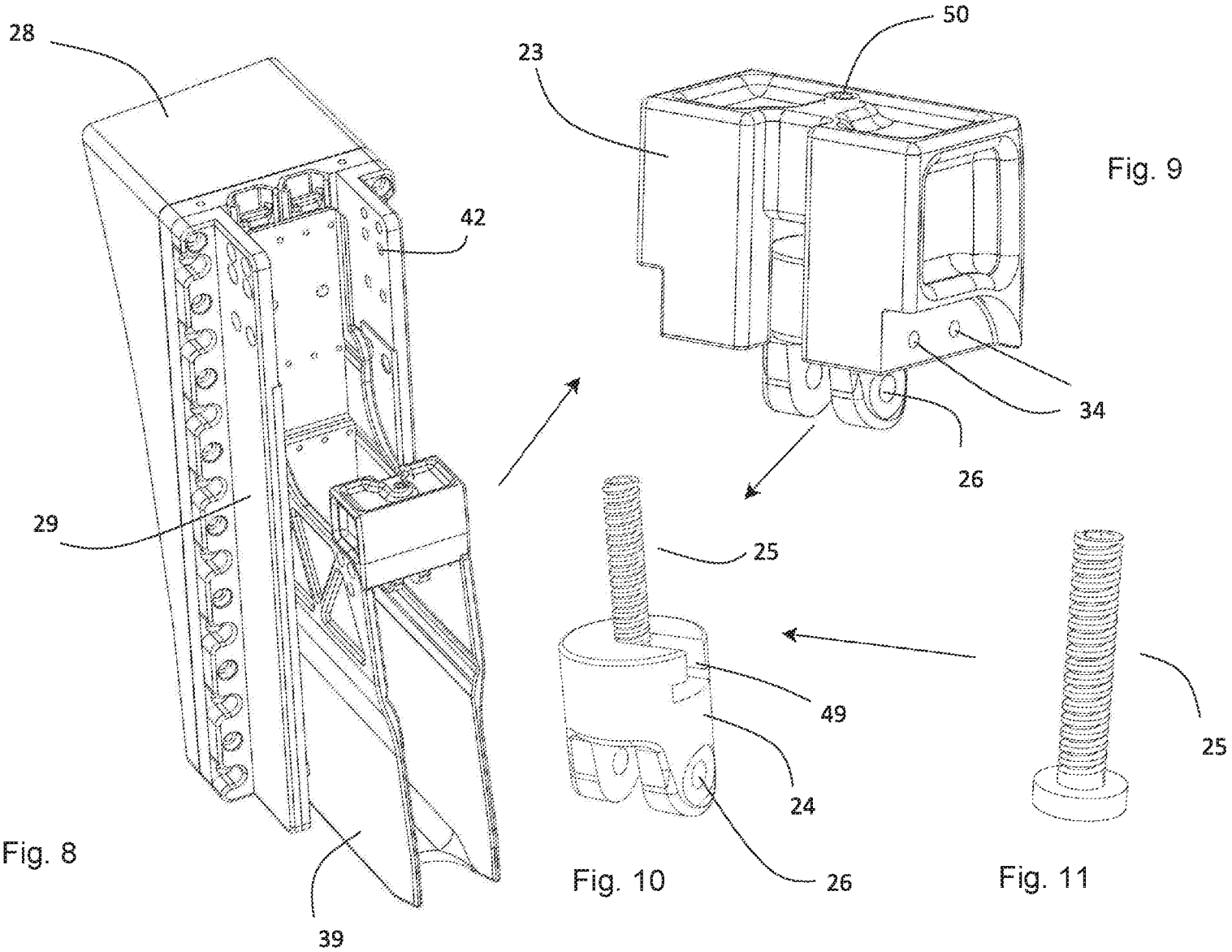
FIG. 8, a view of the casing is shown, as mounted to the transom part.
FIG. 9, a view of the first actuator upper end connecting member is shown.
FIG. 10, a view of the first actuator upper pin bearing end is shown.
FIG. 11, a view of a fastening screw is shown.
Figures 12, 13, 14, 15:
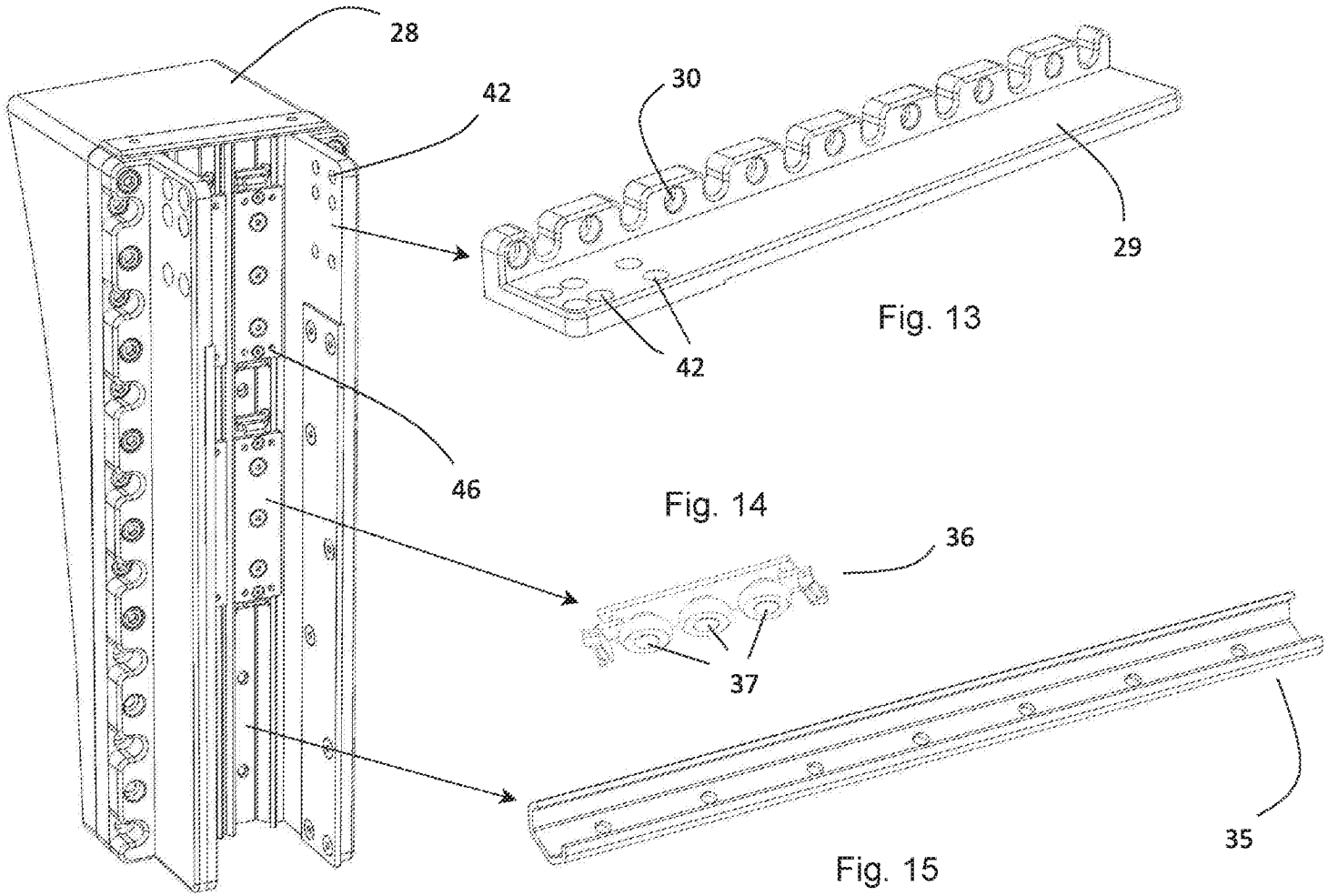
FIG. 12, a view of the slides is shown, as mounted to the transom part.
FIG. 13, a tilted position of a vertical support is shown.
FIG. 14, a view of a slide is shown.
FIG. 15, a tilted position of a rail is shown.

The first actuator (5) is rotatably connected to a pin bearing end (24) at its upper end, as shown in FIGS. 9 and 10. The first actuator upper pin bearing end (24) comprises a cylindrical body and an opposite projection with a hole (26) extending downwards from the cylindrical body. The first actuator (5) also comprises a hole at its upper end, and after the hole is aligned with the first actuator upper pin bearing end holes (26), the parts are connected by means of a pin.

The first actuator upper end connecting member (23) comprises a slot at the center thereof so as to receive the cylindrical part of the first actuator upper pin bearing end (24). The first actuator upper end connecting member (23) further comprises a bolt hole (50) extending vertically at the upper side of the said slot in vertical direction. On the other hand, there is a screw inlet opening (49) on a side of the cylindrical part of the first actuator upper pin bearing end (24) and a fastening bolt (25) is inserted therethrough, with the threaded part facing upwards. After the first actuator upper pin bearing end (24) is inserted in the slot of the first actuator upper end connecting member (23), the fastening screw (25) is aligned with the bolt hole (50) and tightened, and the first actuator upper pin bearing end (24) is connected to the first actuator upper end connecting member (23).

At the lower lateral surfaces of the first actuator upper end connecting member (23), upper end connecting holes (34) are formed. Likewise, upper end connecting holes (33) are provided on the upper, rear sides of the casing side walls (39). The first actuator upper end connecting member (23) is placed between the casing side walls (39) and the holes (34, 33) are aligned, and the first actuator upper end connecting member (23) is connected to the casing side walls (39) by inserting the bolts through these holes and tightening same.

The invention claimed is:

1. A boat stabilizer device comprising:

a foil being structurally independent from a transom of a boat to which said foil is mounted, said foil being tiltable around a transversal axis;

a first actuator engaged to said foil for tilting said foil;

a second actuator engaged to the foil, said second actuator having a lower end and an upper end, said second actuator being engaged to said foil from said lower end;

a connecting member engaged to said transom, said second actuator being engaged to said connecting member from said upper end;

said second actuator vertically moving said foil relative to said transom;

wherein said second actuator provides vertical motion to said foil by a non-manual force, wherein said second actuator comprises a hydraulic piston or an electrical operated piston having a piston rod;

a rotatable member for rotatably connecting said piston rod to said foil, wherein the rotatable member is a pin;

a casing engaged to the piston rod, said casing being movable upwards and downwards, wherein said casing comprises opposite casing side walls and a casing front wall connecting them so as to define an "U" form, wherein said casing comprises sliding means for sliding said casing with respect to the transom; and wherein said sliding means comprise "U" shaped rails extending in a vertical direction relative to the connecting member, and slides engaged to the casing, said slides having rollers movable in the rails.

2. A boat stabilizer device comprising:

a foil being structurally independent from a transom of a boat to which said foil is mounted, said foil being tiltable around a transversal axis;

a first actuator engaged to said foil for tilting said foil, said first actuator having an end;

a second actuator engaged to the foil, said second actuator having a lower end and an upper end, said second actuator being engaged to said foil from said lower end;

a connecting member engaged to said transom, said second actuator being engaged to said connecting member from said upper end;

said second actuator vertically moving said foil relative to said transom;

wherein said second actuator provides vertical motion to said foil by a non-manual force, wherein said second actuator comprises a hydraulic piston or an electrical operated piston having a piston rod;

a rotatable member for rotatably connecting said piston rod to said foil, wherein the rotatable member is a pin;

a casing engaged to the piston rod, said casing being movable upwards and downwards, wherein said casing comprises opposite casing side walls and a casing front wall connecting them so as to define an "U" form, wherein said casing comprises sliding means for sliding said casing with respect to the transom; and said rotatable member rotatably connects said end of said first actuator with the casing.

3. The boat stabilizer device according to claim 2, wherein the rotatable member is a pin.

* * * * *